US006715210B2

(12) United States Patent
Chao

(10) Patent No.: US 6,715,210 B2
(45) Date of Patent: Apr. 6, 2004

(54) SCRAPER

(76) Inventor: Chien-Chuan Chao, No. 13, Lane 15, Sec. 2, Fuhsing Rd., S. Dist., Taichung (TW)

( * ) Notice: Subject to any disclaimer, the term of this patent is extended or adjusted under 35 U.S.C. 154(b) by 21 days.

(21) Appl. No.: 10/179,842

(22) Filed: Jun. 26, 2002

(65) Prior Publication Data

US 2004/0000056 A1 Jan. 1, 2004

(51) Int. Cl.[7] ..... A47L 13/022; A47L 13/08

(52) U.S. Cl. ..... 30/169

(58) Field of Search ..... 30/169, 30, 330; 15/236.01

(56) References Cited

U.S. PATENT DOCUMENTS 4,575,936 A * 3/1986 Gringer ..... 30/169

* cited by examiner

*Primary Examiner*—Douglas D. Watts
(74) *Attorney, Agent, or Firm*—Fei-Fei Chao; Venable LLP

(57) ABSTRACT

A scraper includes a primary jaw having a first top edge, and a secondary jaw having a second top edge and a bottom tail. The top edges of the jaws are normally opposite to each other. The secondary jaw is connected to the primary jaw between the second top edge and the bottom tail in a relationship of being movable and slightly rotatable with respect to the primary jaw. A wheel screw is threaded engaged with the primary jaw and adapted to move the bottom tail of the secondary jaw away from the primary jaw. Therefore, a blade may be held tightly between the top edges of the jaws when the wheel screw is tightened.

7 Claims, 7 Drawing Sheets

SCRAPER

BACKGROUND OF THE INVENTION

1. Field of the Invention

The present invention relates to a scraper and, more particularly, to a scraper in which a blade can be removed or replaced easily.

2. Description of Related Art

A scraper, typically in the form of a blade fixed to a grip, is widely used to scrape off paint or other adhesive matter. It has to be discarded whenever the blade becomes useless, a situation much earlier than found with the grip.

Many attempts have been made to solve the problem. Now a scraper is known in which a blade is partially covered with a pair of grip halves screwed to the blade. This blade can be removed or replaced, but not easily for it requires a screwdriver to unscrew the grip halves.

An additional problem is that the blade usually becomes sharpened during its use. The sharpened blade is likely to damage the article being scraped, and worse, hurt the user while handling the scraper.

Therefore, it is an objective of the invention to provide a scraper to mitigate and/or obviate the aforementioned problems.

SUMMARY OF THE INVENTION

The object of the present invention is to provide a scraper in which a blade can be removed or replaced easily.

Another object of the present invention is to provide a scraper in which a blade will not damage a work piece or hurt anyone as the scraper is being handled.

Other objects, advantages and novel features of the invention will become more apparent from the following detailed description when taken in conjunction with the accompanying drawings.

DETAILED DESCRIPTION OF THE PREFERRED EMBODIMENT

The figures show a preferred embodiment of a scraper in accordance with the present invention, such as for scraping off paint or other adhesive matter.

Figure 1:
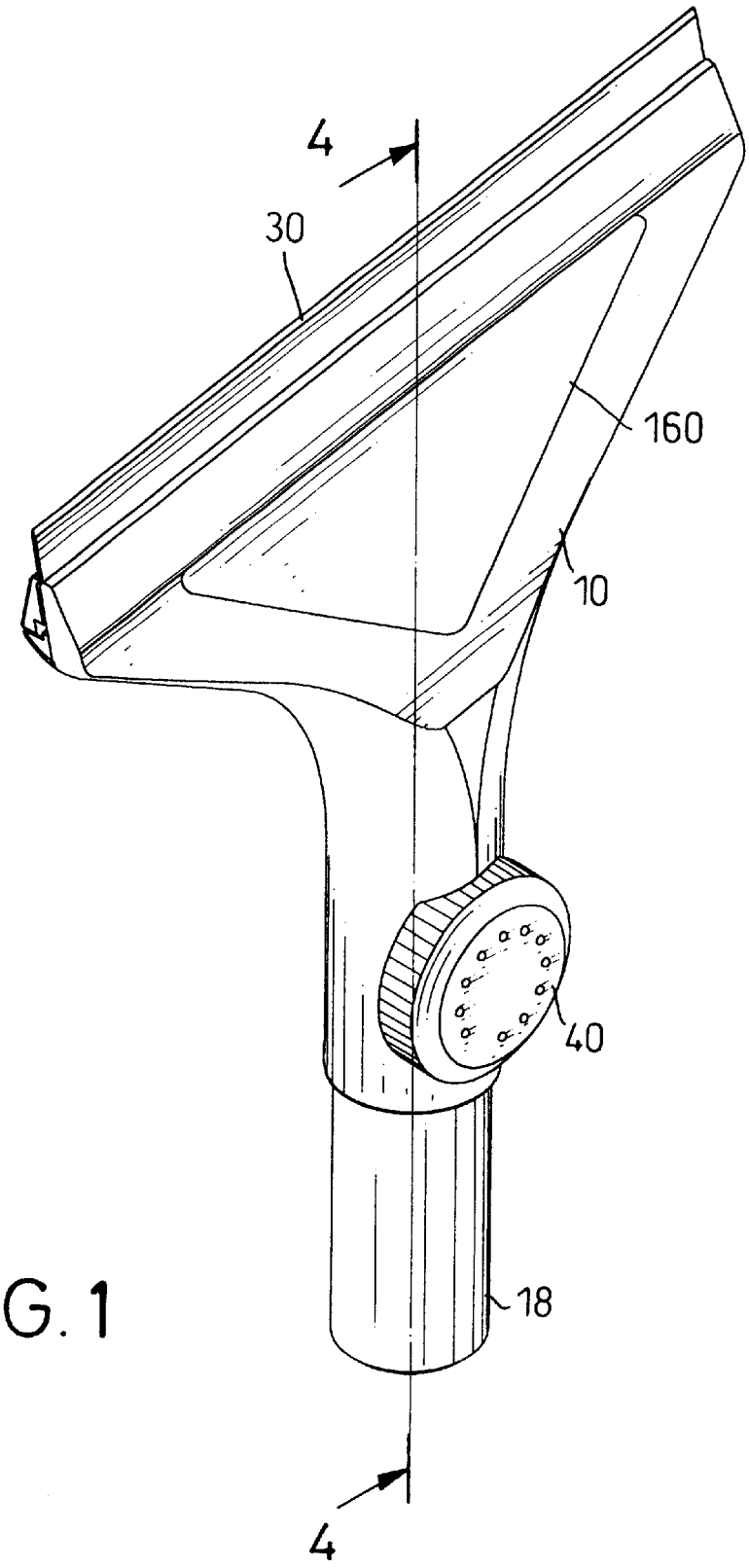
FIG. 1 is a perspective front view of a preferred embodiment of a scraper in accordance with the present invention.
Figure 2:
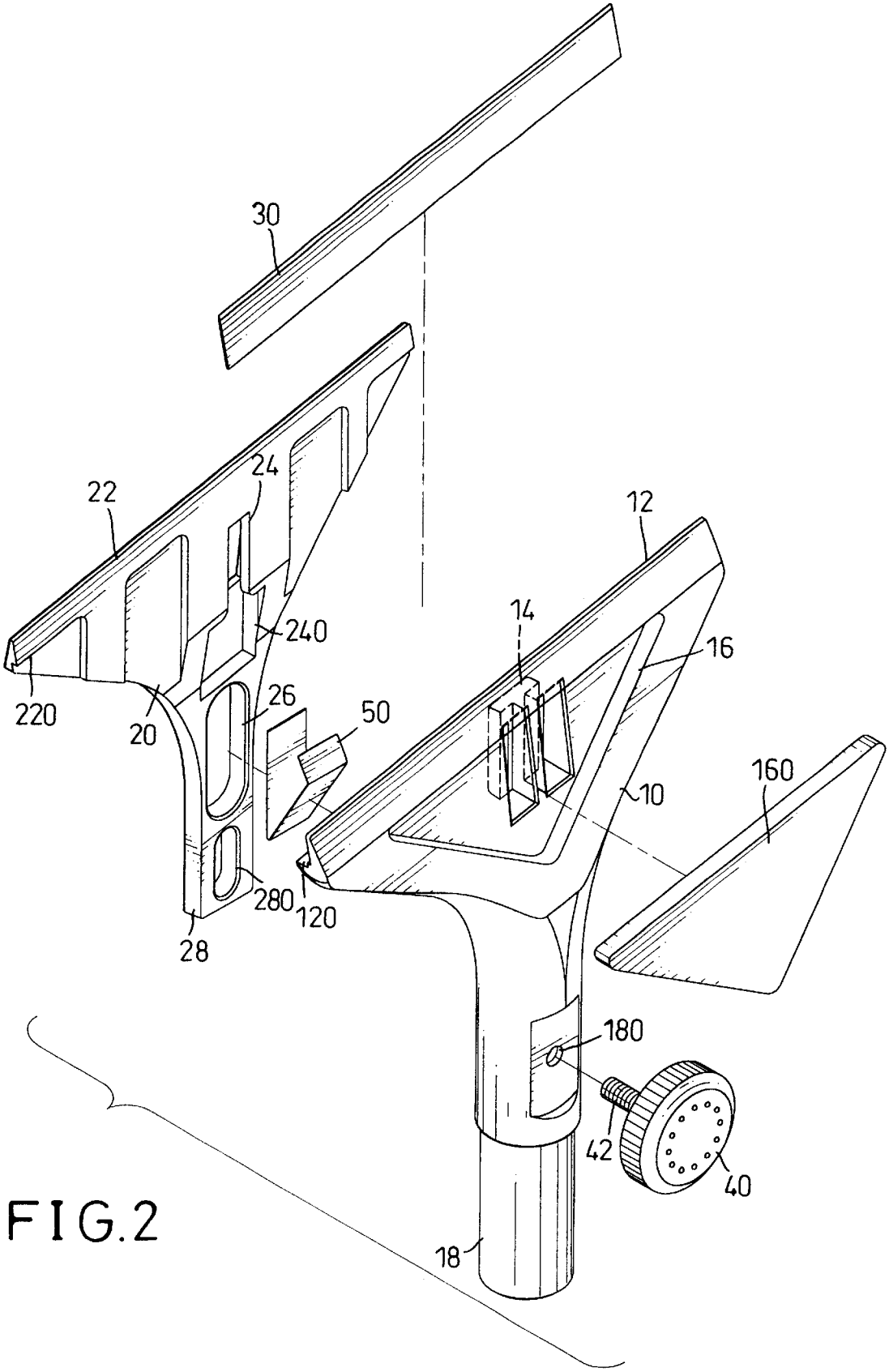
FIG. 2 is an exploded perspective view of the scraper shown in FIG. 1.

Referring to FIGS. 1 and 2, the inventive scraper includes a primary jaw (10) and a secondary jaw (20), with the primary jaw (10) having a first top edge (12) and a bottom grip (18) and the secondary jaw (20) having a second top edge (22) and a bottom tail (28). The top edges (12, 22) of the jaws (10, 20) are normally opposite to each other for holding a blade (30) therebetween.

The secondary jaw (20) is further provided between its second top edge (22) and its bottom tail (18) with a contoured slot (24) in communication with a lower recess (240), while the primary jaw (10) has a protrusion (14) extendable into the recess (24) and engagable with the contoured slot (24). The protrusion (14) and the contoured slot (24) must be configured and dimensioned so that the secondary jaw (20) may be connected to the primary jaw (10) in a relationship of being movable and slightly rotatable with respect to the primary jaw (10).

In the illustrated embodiment, the protrusion (14) of the primary jaw (10) has a T-shaped configuration and, accordingly, the contoured slot (24) of the secondary jaw (20) is configured into a T slot which mates with the T-shaped protrusion (14).

Figure 3:
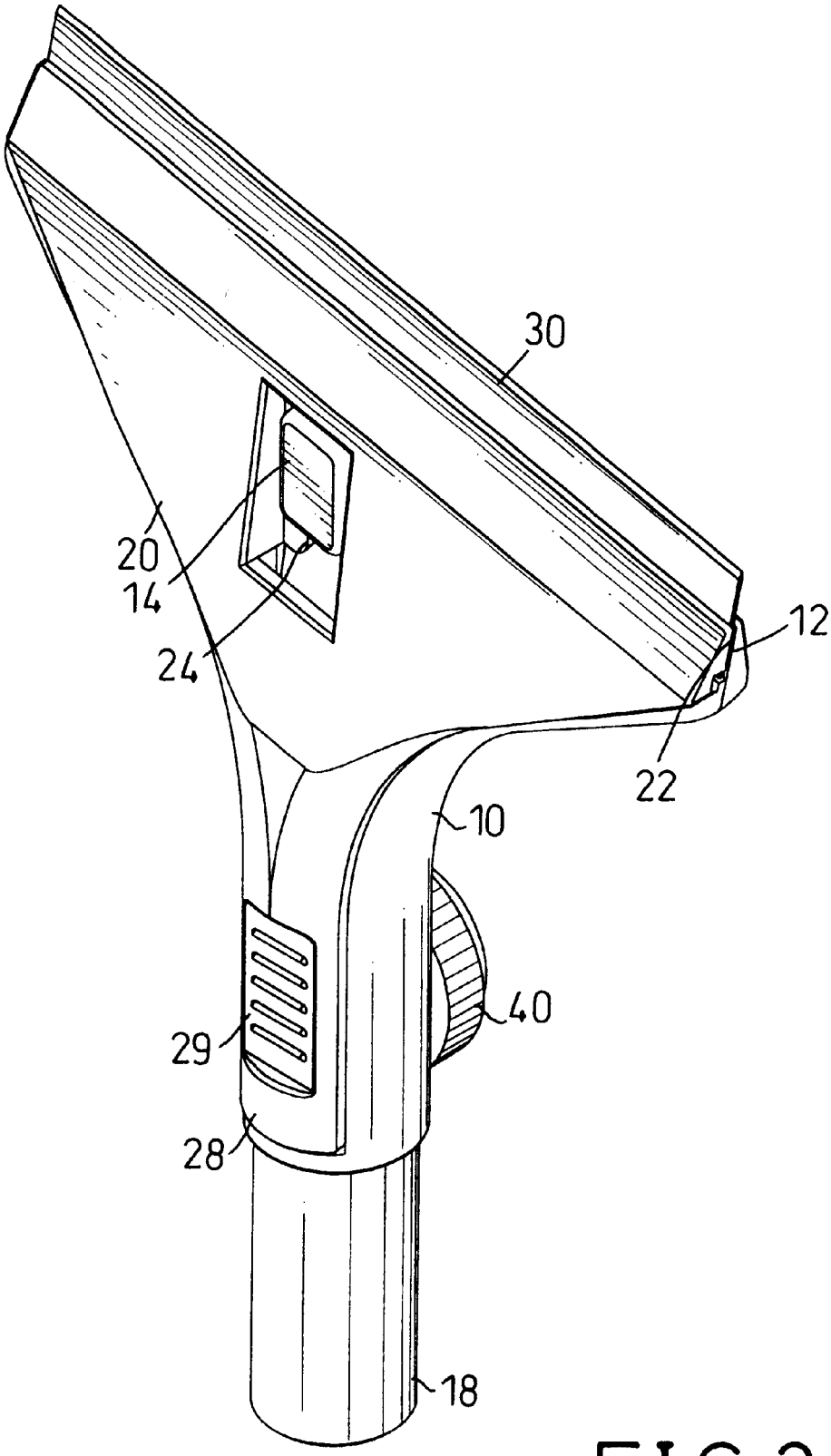
FIG. 3 is a perspective back view of the scraper shown in FIG. 1.

Referring to FIGS. 2 and 3, the two jaws (10, 20) can be interconnected by placing the protrusion (14) into the recess (240) of the secondary jaw (20), which is then moved downward relative to the primary jaw (10) until the T-shaped protrusion (14) slides into the contoured T slot (24), as shown in FIG. 3.

Figure 4:
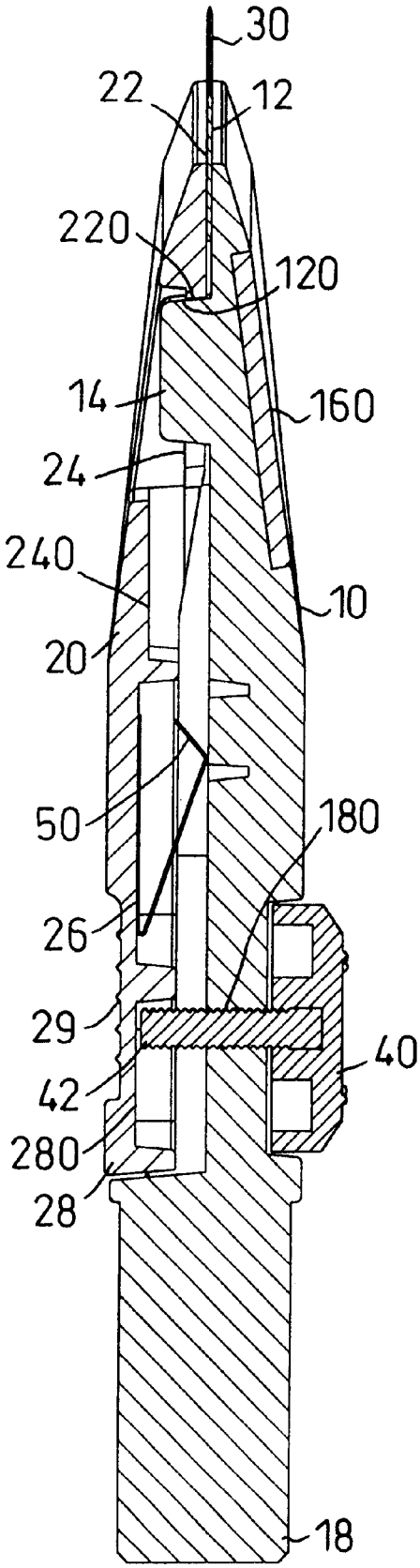
FIG. 4 is a cross-sectional side view of the scraper of FIG. 1.
Figure 5:
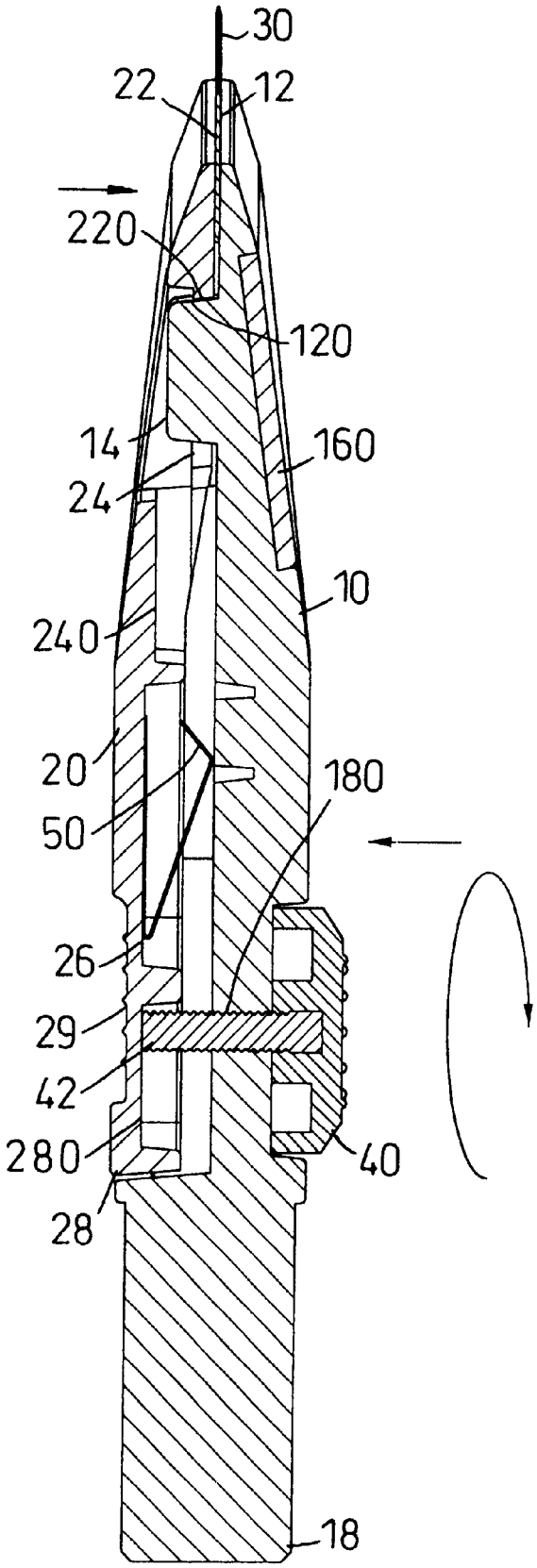
FIG. 5 is a cross-sectional side view of the scraper of FIG. 1, showing a wheel screw being tightened.

Referring to FIGS. 4 and 5, the scraper further includes a wheel screw (40) adapted to move the bottom tail (28) of the secondary jaw (20) away from the primary jaw (10), so as to enable the blade (30) to be held tightly between the top edges (12, 22) of the jaws (10, 20).

In detail, the wheel screw (40) has a threaded shank (42) threadedly engaged with a threaded hole (180) which is defined in the primary jaw (10) in a location adjacent to the grip (18), as best shown in FIG. 2. The threaded shank (42) extends through the threaded hole (180) into a pit (280) defined in the bottom tail (28) of the secondary jaw (20)

When the wheel screw (40) is turned in a correct direction as designated by the arrow in FIG. 5, the threaded shank (42) is finally brought into contact with the bottom tail (28). The rotating wheel screw (40) then moves the tail (28) and slightly turns the secondary jaw (20) in a clockwise direction, as viewed in FIG. 5, about a point where the T-shaped protrusion (14) is engaged with the contoured T slot (24), thus moving the second top edge (22) nearer the first top edge (12), thereby enabling the blade (30) to be held tightly between the top edges (12, 22) of the jaws (10, 20) when the wheel screw (40) is tightened.

In a highly preferred embodiment, there is an additional stem (16) formed on the primary jaw (10) and oriented towards the secondary jaw (20) in a location between the contoured T slot (24), and a spring (50) mounted around the stem (16) and compressed between the jaws (10, 20). Preferably, the compressed spring (50) is partially received in an elongated indentation (26) defined in an inner face of the secondary jaw (20), as best shown in FIG. 2. As a result, the blade (30) can be held between the top edges (12, 22) of the jaws (10, 20) even when the wheel screw (40) is unscrewed.

After the wheel screw (40) has been unscrewed, the blade (30) can be removed from the interconnected jaws (10, 20) by pressing the bottom tail (28) towards the primary jaw (10), especially at a knurled area (29) which is formed on an outer face of the bottom tail (28), as best shown in FIG. 3.

The movement of the bottom tail (28) turns the secondary jaw (20), against the compressed spring (50), in a counterclockwise direction as viewed in FIG. 4 about the point where the T-shaped protrusion (14) is engaged with the contoured T slot (24), and so the top edges (12, 22) of the jaws (10, 20) are moved away from each other. This allows the blade (30) to be removed from and a substituting blade (30) to be placed between the top edges (12, 22).

The substituting blade (30) is held there, by the action of the compressed spring (50), as soon as the bottom tail (28) of the secondary jaw (20) is released, and is held more and more tightly between the top edges (12, 22) as the wheel screw (40) is tightened.

Figure 6:
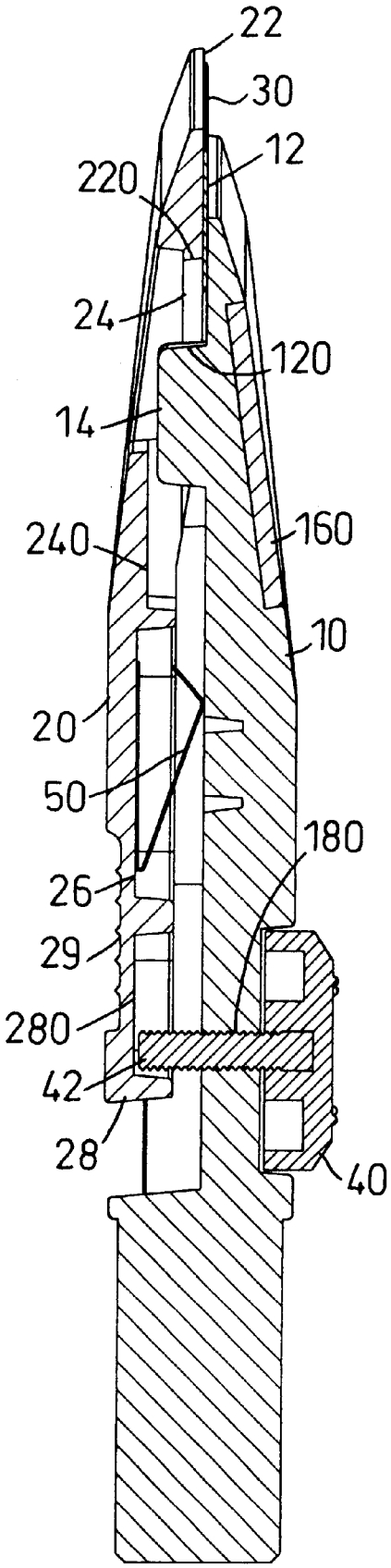
FIG. 6 is a cross-sectional side view of the scraper of FIG. 1, showing a secondary jaw moved upward to cover a blade.
Figure 7:
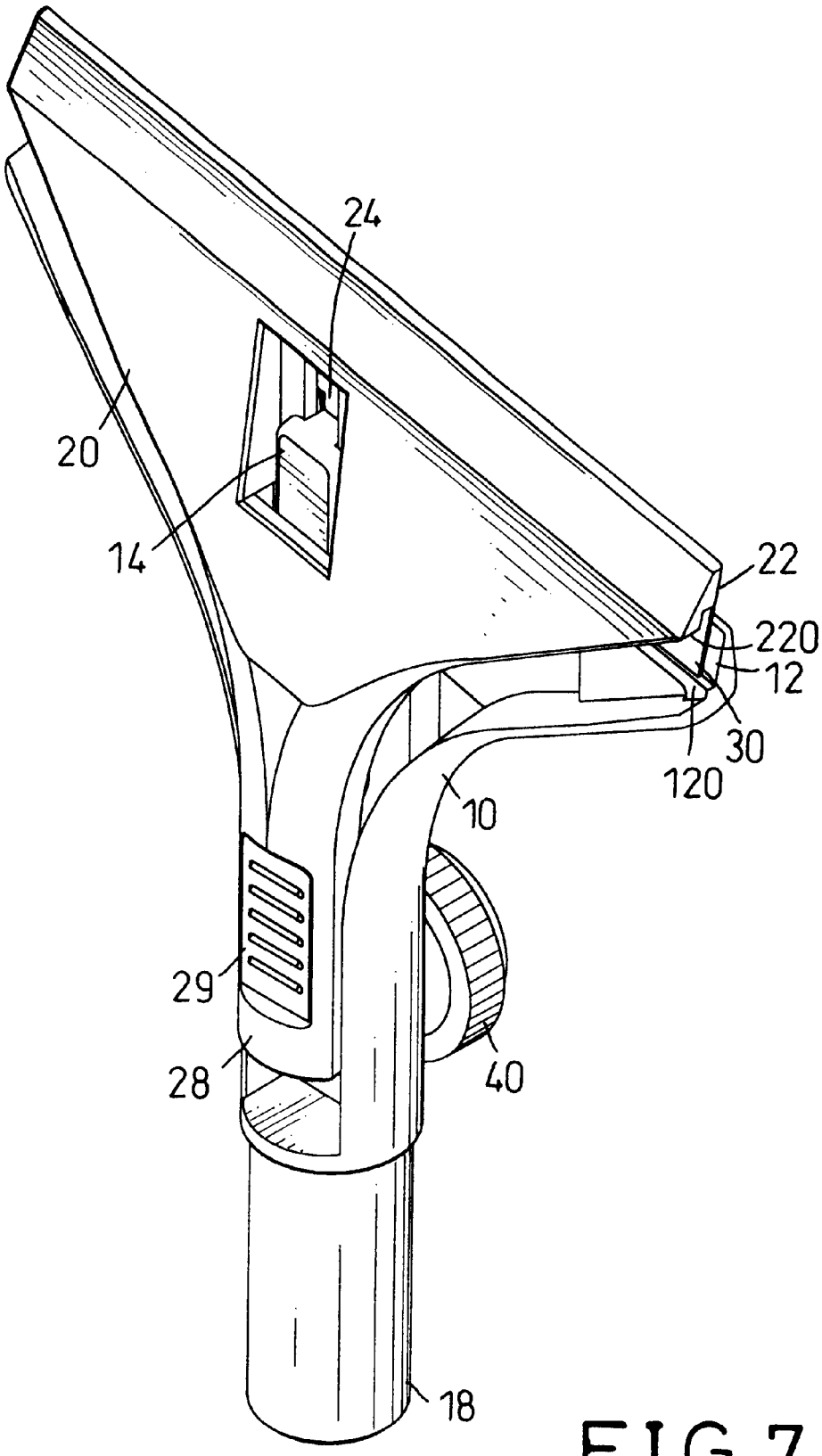
FIG. 7 is a perspective back view of the scraper of FIG. 1, showing the secondary jaw moved upward to cover the blade.

Referring to FIGS. 6 and 7, if the inventive scraper is intended to be transported, the blade (30) can be covered with the secondary jaw (20) by moving the same secondary jaw (20) upward relative to the primary jaw (10) after unscrewing the wheel screw (40). This position of the scraper protects the blade (30) from damage and the user or anyone else from accidental hurt from the blade (30).

Whenever the inventive scraper is to be used, the blade (30) can easily be uncovered by moving the secondary jaw (20) downward relative to the primary jaw (10) till an upper wall (220) of the T slot (24) abuts an upper face (120) of the T-shaped protrusion (14), as shown in FIG. 4. The scraper is got ready for use as soon as the wheel screw (40) is tightened again.

Referring still to FIG. 6, the pit (280) of the secondary jaw (20) should be defined so that the threaded shank (42) of the wheel screw (40) abuts a lower wall of the pit (280) whenever the secondary jaw (20) is moved upward relative to the primary jaw (10) to cover the blade (30). In this relative position of the secondary jaw (20) the T-shaped protrusion (14) is still engaged with the contoured T slot (24), at least partially, which prevents the secondary jaw (20) from separating from the primary jaw (10).

The wheel screw (40) should be turned so that its threaded shank (42) is moved away from the pit (280) whenever the secondary jaw (20) is desired to be separated from the primary jaw (10). At this time, the secondary jaw (20) can be moved further upward relative to the primary jaw (10) until the T-shaped protrusion (14) is disengaged from the contoured T slot (24) and comes into the recess (240), from which the protrusion (14) can be taken out.

From the foregoing, it is apparent that this invention has the following advantages of enabling the blade (30) to be removed and replaced easily, as well as protecting the blade (30) from damage and the user or anyone else from accidental hurt from the blade (30).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A scraper comprising:

a primary jaw (10) having a first top edge (12) and a T protrusion (14);

a second jaw (20) having a second top edge (22), a bottom tail (28), and a T slot (24) between said second top edge (22) and said bottom tail (28), said top edges (12, 22) of said jaws (10, 20) being normally opposite to each other;

said T slot (24) of said secondary jaw (20) being connected to said T protrusion (14) of said primary jaw (10) between said second top edge (22) and said bottom tail (28) in a relationship of being movable and slightly rotatable with respect to said primary jaw (10); and a wheel screw (40) threaded engaged with said primary jaw (10) and adapted to move said bottom tail (28) of said secondary jaw (20) away from said primary jaw (10);

whereby a blade (30) may be held tightly between said top edges (12, 22) of said jaws (10, 20) when said wheel screw (40) is tightened.

2. The scraper as claimed in claim 1, wherein said primary jaw (10) has a bottom grip (18).

3. The scraper as claimed in claim 2, wherein said primary jaw (10) defines a threaded hole (180) adjacent to said grip (18), and wherein said wheel screw (40) has a threaded shank (42) threadedly engaged with and extending through said threaded hole (180) to move said bottom tail (28) of said secondary jaw (20).

4. The scraper as claimed in claim 3, wherein said secondary jaw (20) has a pit (280) defined in said bottom tail (28), and wherein said threaded shank (42) aid wheel screw (40) extends into said pit (280) of said secondary jaw (20).

5. The scraper as claimed in claim 1, wherein said primary jaw (10) has a stem (16) oriented towards said secondary jaw (20) in a location between said T slot (24) and said bottom tail (28), and wherein a spring (50) is mounted around said stem (16) and compressed between said jaws (10, 20).

6. The scraper as claimed in claim 5, wherein said secondary jaw (20) has an elongated indentation (26) defined in an inner face thereof for partially receiving said spring (50).

7. The scraper as claimed in claim 5, wherein said secondary jaw (20) has a knurled area (29) formed on an outer face of said bottom tail (28).

* * * * *